US009463503B2

(12) United States Patent
Chen et al.

(10) Patent No.: US 9,463,503 B2
(45) Date of Patent: Oct. 11, 2016

(54) METHOD OF MAKING A SPANNER

(71) Applicants: Ming-Chang Chen, Kaohsiung (TW); Mao-Chih Liao, Kaohsiung (TW)

(72) Inventors: Ming-Chang Chen, Kaohsiung (TW); Mao-Chih Liao, Kaohsiung (TW)

( * ) Notice: Subject to any disclaimer, the term of this patent is extended or adjusted under 35 U.S.C. 154(b) by 31 days.

(21) Appl. No.: 14/580,294

(22) Filed: Dec. 23, 2014

(65) Prior Publication Data

US 2016/0158827 A1 Jun. 9, 2016

(30) Foreign Application Priority Data

Dec. 9, 2014 (TW) ..... 103142808 A

(51) Int. Cl.
*B21K 5/16* (2006.01)

(52) U.S. Cl.
CPC ..... *B21K 5/16* (2013.01)

(58) Field of Classification Search
CPC ..... B21K 5/16
USPC ..... 76/114
See application file for complete search history.

(56) References Cited

U.S. PATENT DOCUMENTS 1,564,167 A * 12/1925 Witherow ..... B21J 5/027 76/114
4,061,507 A * 12/1977 Allmendinger ..... B21D 28/06 148/610
5,083,008 A * 1/1992 Zerver ..... B21J 5/02 219/121.69
8,196,493 B2 * 6/2012 Hu ..... B21J 5/02 72/339
2004/0089104 A1 * 5/2004 Hsien ..... B21K 5/16 76/114
2016/0158827 A1 * 6/2016 Chen ..... B21K 5/16 76/119

FOREIGN PATENT DOCUMENTS

EP 2 937 159 A1 * 10/2015 ..... B21K 5/16

* cited by examiner

*Primary Examiner* — Hwei C Payer
(74) *Attorney, Agent, or Firm* — Alan D. Kamrath; Kamrath IP Lawfirm, P.A.

(57) ABSTRACT

A method of making a spanner comprises the steps of preparing a flat metal blank, forging and pressing a part of the metal blank to form a head and a shank whose width is smaller than a width of the head, pressing the head to form a first arch-shaped part, pressing a shank end of the shank to expand the shank end and then form a second arch-shaped part, and pressing the head and the shank end again to remove redundant scrap projecting from the first arch-shaped part and the second arch-shaped part and also punch finished holes in the head and the shank end respectively, thereby completing the finished spanner. Accordingly, the method reduces the waste of the material and the processing cost, decreases the use frequency of high-cost machines and promotes the processing efficiency by using the flat metal blank.

9 Claims, 12 Drawing Sheets

METHOD OF MAKING A SPANNER

BACKGROUND OF THE INVENTION

1. Field of the Invention

This invention relates to a spanner shaping method and relates particularly to a method of making a spanner capable of reducing the waste of the material, shortening the processing time and decreasing the cost.

2. Description of the Related Art

Referring to FIG. 1 and FIG. 2, a traditional method 1 of making a spanner S1 is carried out by hot forging. The method 1 comprises a preparing step 11, a cutting step 12, a heating step 13, a punching step 14, a cooling step 15 and a removing step 16. The preparing step 11 prepares a rolled round metal blank a. The cutting step 12 cuts the blank a into a proper length. The heating step 13 applies a heater 131 providing a fixed and high temperature to heat and soften the blank a. A punch 141 and dies 142 disposed on the punch 141 and provided with a shaping impress are used in the punching step 14. The punching step 14 puts the heated and softened blank a on the dies 142, pressurizes the round blank a to form a flat blank al and presses the flat blank al to build an impression of a spanner outline R. The cooling step 15 cools the impressed flat blank al. The removing step 16 prepares a removing machine 161 to remove the residual metal along the peripheral edge of the spanner outline R. Therefore, a finished spanner S1 is completed. However, such heating method requires a high cost for processing with correlated heating machines. Further, the heated blank al can only be shaped after the cooling step 15 is done, and this requires more complicated actions and takes much time.

Referring to FIG. 3 and FIG. 4, a further traditional method 3 of making a spanner S2 is carried out by cold forging. The method 3 comprises a preparing step 31, a head forming step 32, a stamping 33 and a removing step 34. The preparing step 31 prepares a round metal blank b. The head forming step 32 is executed by cold-forging two ends of the round metal blank b to form two round heads h. The stamping 33 uses a stamping press (not shown) to press the round metal blank b with two round heads h whereby the round metal blank b is formed into a flat blank b1 with a spanner outline. The removing step 34 removes the residual metal along the peripheral edge of the spanner outline of the flat blank b1 with another stamping press (not shown). Therefore, a finished spanner S2 is completed. Generally, because the round metal blank b and the round heads h formed at two ends thereof are thick, the metal blank b must be pressed by a particular press. The stamping step 33, however, must prepare a stamping press whose power output and weight is much larger than those of the press used in the head forming step 32 to provide enough driving forces to press the round metal blank b into the flat blank b1 and shape the spanner outline. Therefore, the bulk and the cost of the necessary stamping presses used in the above steps may be much higher than those of the common stamping presses, and this usually increases the processing cost for making the finished spanner S2.

SUMMARY OF THE INVENTION

An object of this invention is to provide a method of making a spanner which reduces the waste of the material, shortens the processing time and decreases the manufacturing cost.

The method of making a spanner of this invention comprises the steps of preparing a flat metal blank (preparing step), forging and pressing a part of the flat metal blank for forming a head and forming a shank which is forged and extended outwards from said head, wherein a width of the shank is smaller than a width of the head (initial forging step), pressing the head to form a first arch-shaped part (first end stamping step), pressing a shank end of the shank far away from the head to expand the shank end and forma second arch-shaped part whose size is smaller than a size of the first arch-shaped part (a second end stamping step), and pressing the head and the shank end again to remove scrap or redundant metal projecting from their arch-shaped parts and punch respective finished holes in the head and the shank end, thereby completing a finished spanner (trimming step). Consequently, the preparation of the flat metal blank for processing facilitates the shortened processing time, the promoted processing efficiency and the reduced amount of scrap and prevents the waste of the material.

Preferably, a width of the flat metal blank in the preparing step equals a maximum outer diameter of the finished spanner.

Preferably, when the flat metal blank is prepared as a continuously rolled flat metal blank, a cutting step follows the preparing step. The cutting step cuts the metal blank into sections by using a cutting machine whereby each section of the metal blank is gripped and fed for continuing the initial forging step.

Preferably, the first end stamping step can not only form the first arch-shaped part by pressing the head but punch a first archetypal hole as an initial form of the finished hole in the first arch-shaped part. Likewise, the second end stamping step can not only form the second arch-shaped part by pressing the shank end but punch a second archetypal hole as an initial form of the finished hole in the second arch-shaped part.

Preferably, the first end stamping step applies a heading machine to press the head. The heading machine comprises a body, a fixing die and a push unit disposed on the body, a press die disposed opposite the fixing die and a grip unit disposed on the body for gripping and moving the metal blank to where the fixing die is located. The fixing die forms a shaping cavity and a discharging hole communicating with the shaping cavity. The push unit can be inserted into the discharging hole.

Preferably, the second end stamping step applies a forming machine to press the shank end. The forming machine comprises a pair of lateral dies on which a die cavity is formed and a stamping die disposed in relation to the lateral dies. The shank is gripped by the lateral dies for executing the pressing action.

Preferably, the heat treatment is further added in this invention. Especially, a heating step is executed before the initial forging step, the first end stamping step or the second end stamping step. Alternatively, the initial forging step, the first end stamping step and the second end stamping step come after a first heating step, a second heating step and a third heating step respectively.

BRIEF DESCRIPTION OF THE DRAWINGS

FIG. 6-1 is a perspective representation of making the spanner in accordance with the first preferred embodiment of this invention;

FIG. 6-2 is another perspective representation of making the spanner in accordance with the first preferred embodiment of this invention;

FIG. 7-1 is a block diagram showing the correlated elements of the heading machine of this invention;

FIG. 7-2 is a schematic view showing the heading machine of this invention;

FIG. 8-1 is a block diagram showing the correlated elements of the forming machine of this invention;

FIG. 8-2 is a schematic view showing the forming machine of this invention;

DETAILED DESCRIPTION OF THE PREFERRED EMBODIMENTS

Figure 1:
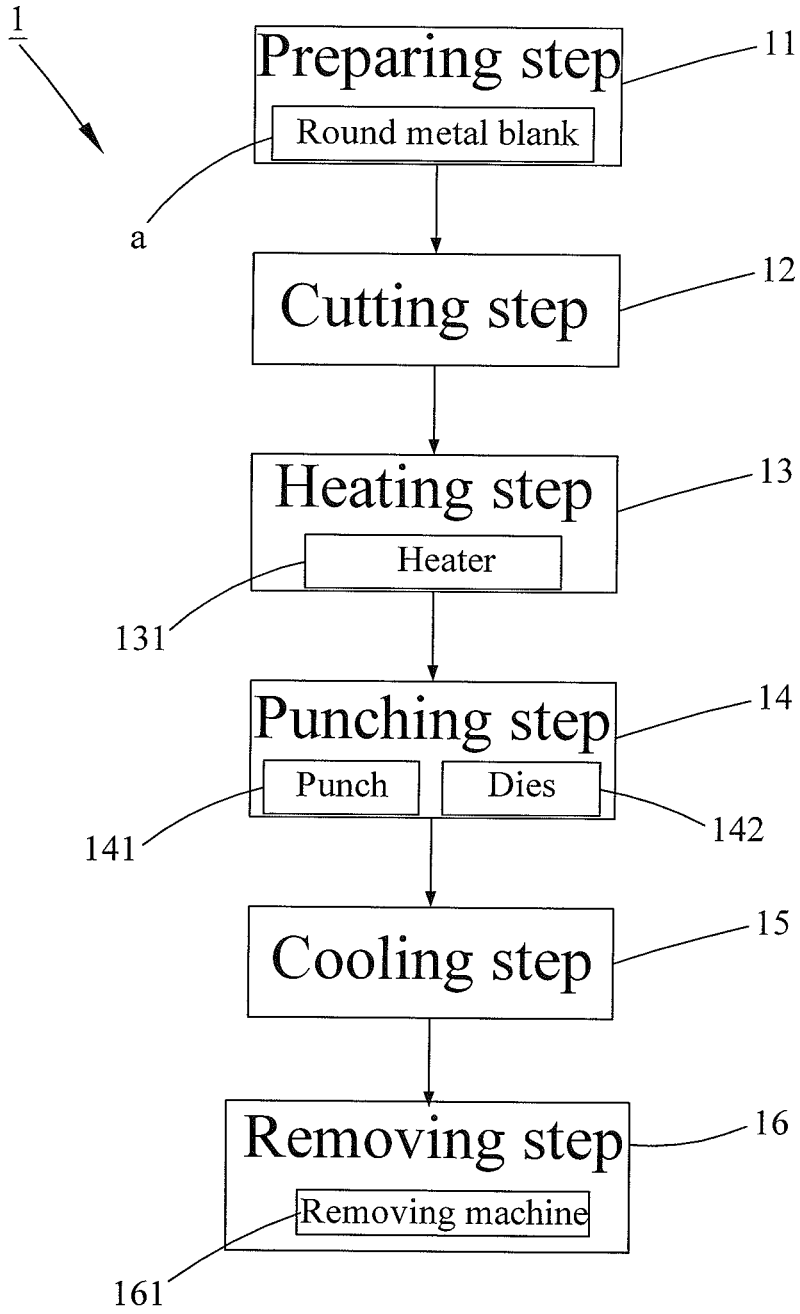
FIG. 1 (PRIOR ART)
FIG. 1 is a block diagram of a first traditional method showing the steps of making a spanner.
Figure 5:
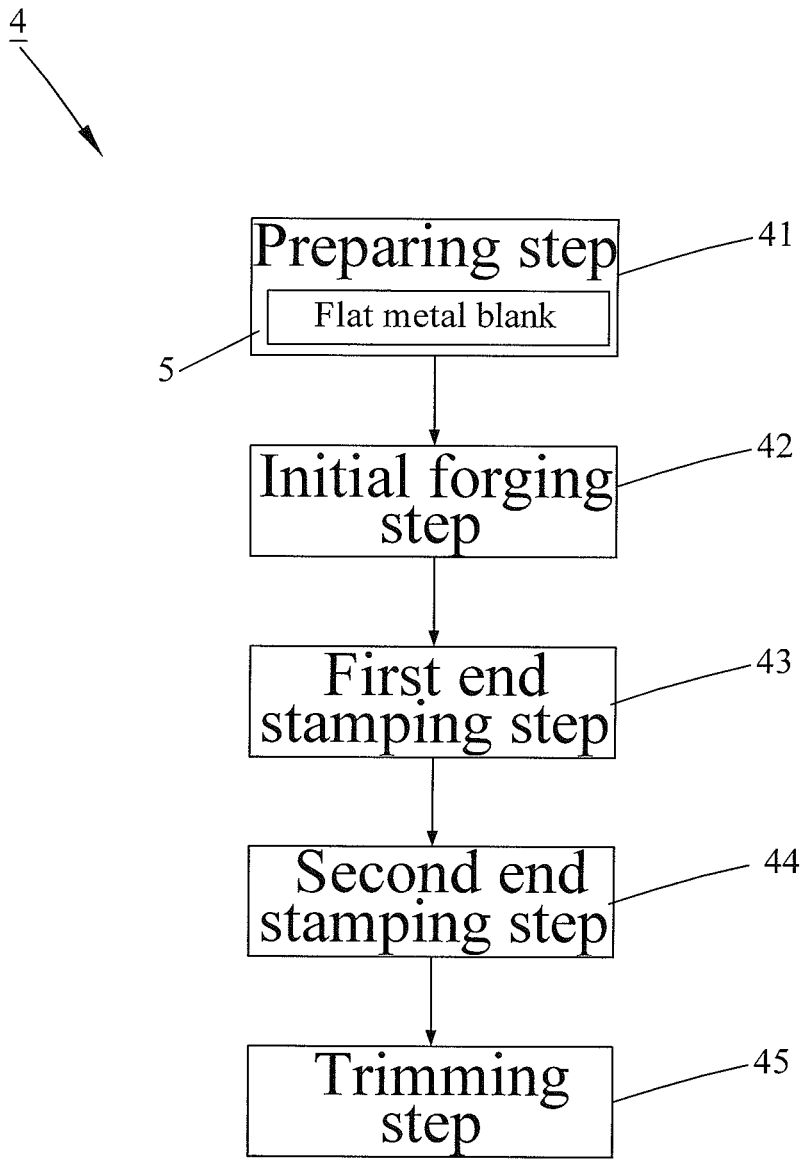
FIG. 5 is a block diagram of a first preferred embodiment of this invention showing the steps of making a spanner.
Figures 1, 6:
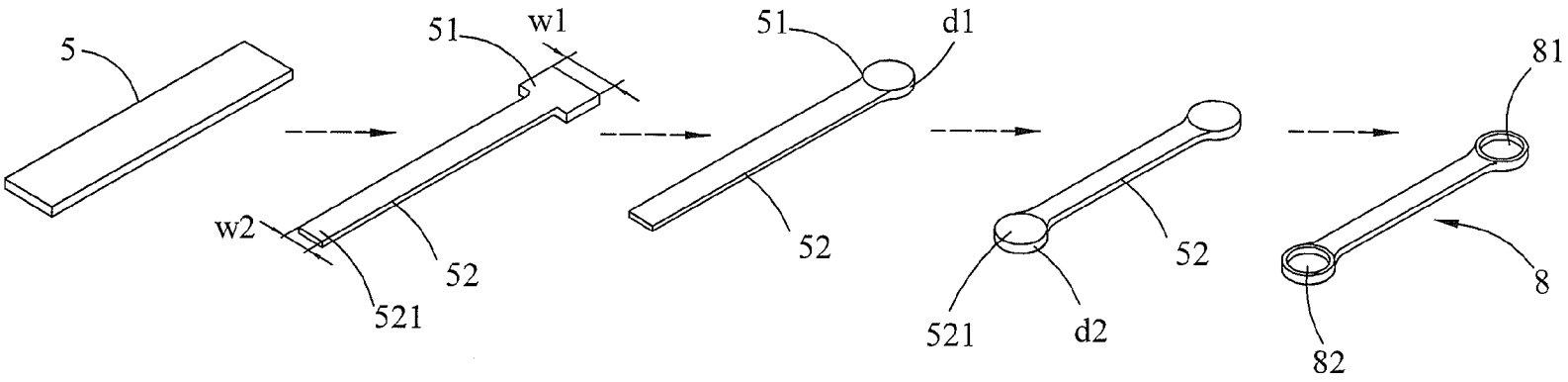
Figures 2, 6:
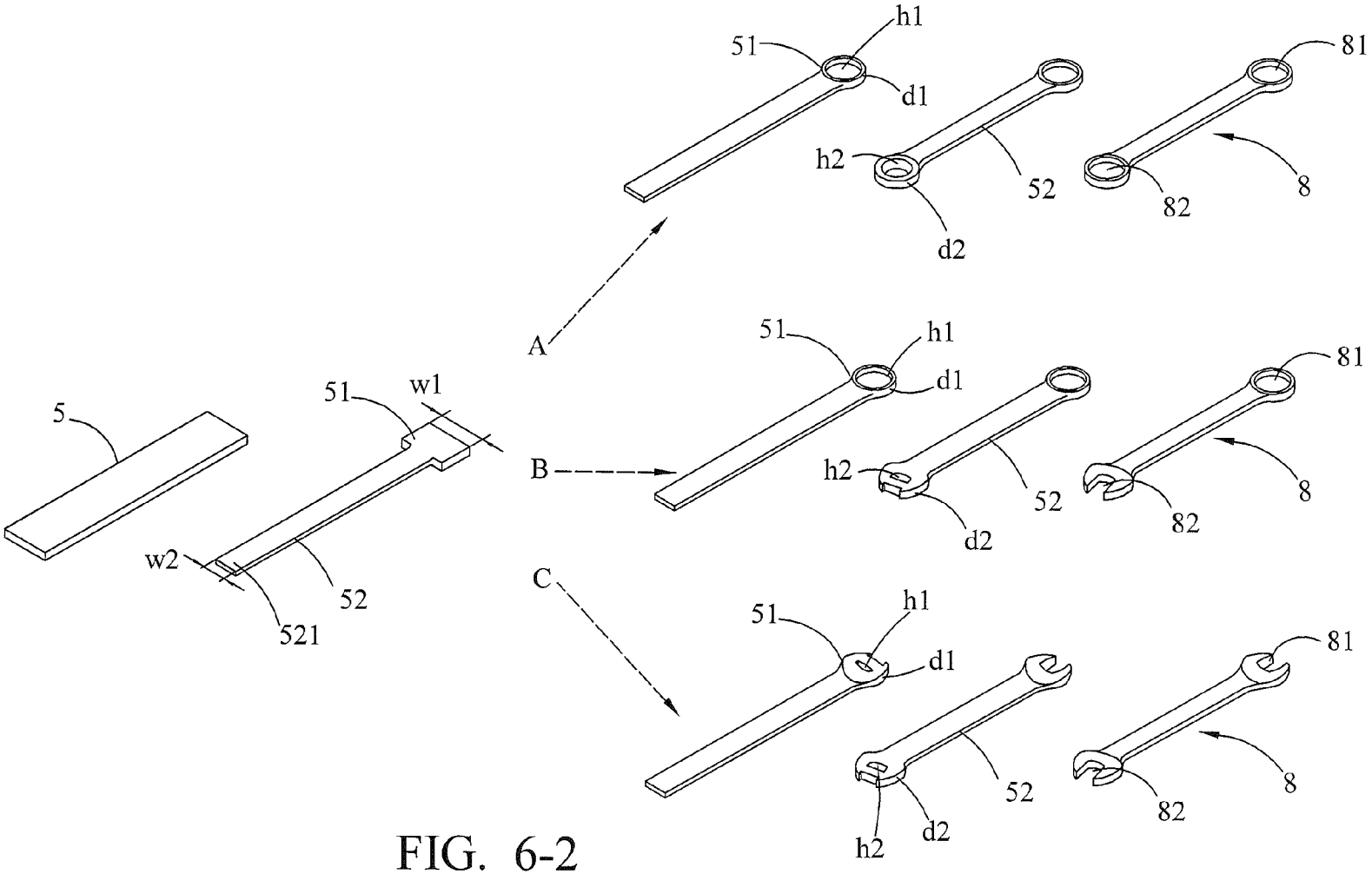

Referring to FIG. 5 and FIG. 6-1, a method 4 of a first preferred embodiment of this invention for making a spanner 8 comprises a preparing step 41, an initial forging step 42, a first end stamping step 43, a second end stamping step 44 and a trimming step 45. The preparing step 41 prepares a flat metal blank 5. Herein, the flat metal blank 5 has a shape with four straight sides. It can be especially rectangular in shape as shown. As used herein, a width of the flat metal blank 5 at least equals a maximum outer diameter of the finished spanner 8, and a thickness of the flat metal blank 5 equals a thickness of the finished spanner 8. The initial forging step 42 forges and presses a part of the flat metal blank 5. In this step, the initial forging step 42 subjects a part of the flat metal blank 5 to compressive forces. Therefore, a head 51 and a shank 52 extended outwards from the head 51 are formed into a T-shaped contour. Specifically, the head 51 is formed at one end of the flat metal blank 5, and the compressed shank 52 connected to the head 51 provides a reduced width w2 smaller than a width w1 of the head 51. By this step, it is possible that the width w1 of the head 51 equals the original width of the flat metal blank 5.

Figure 2:
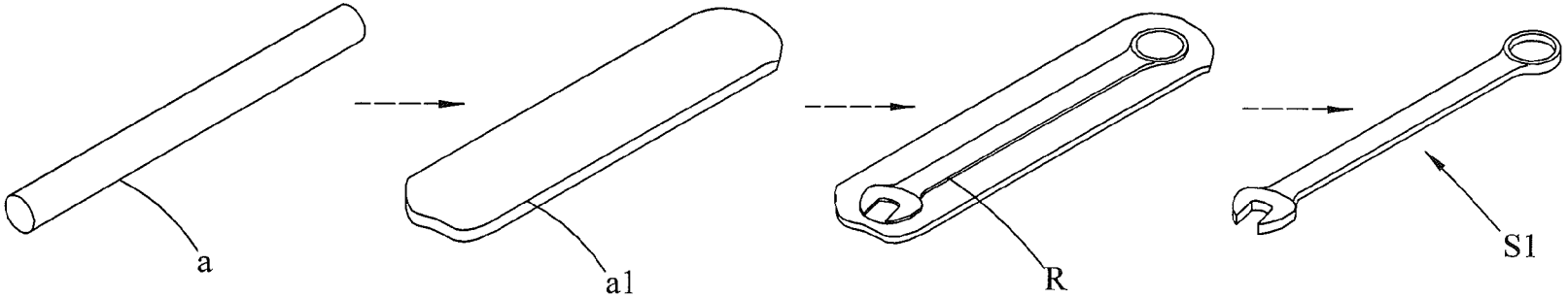
FIG. 2 (PRIOR ART)
FIG. 2 is a perspective representation of making the spanner in accordance with the first traditional method.
Figure 3:
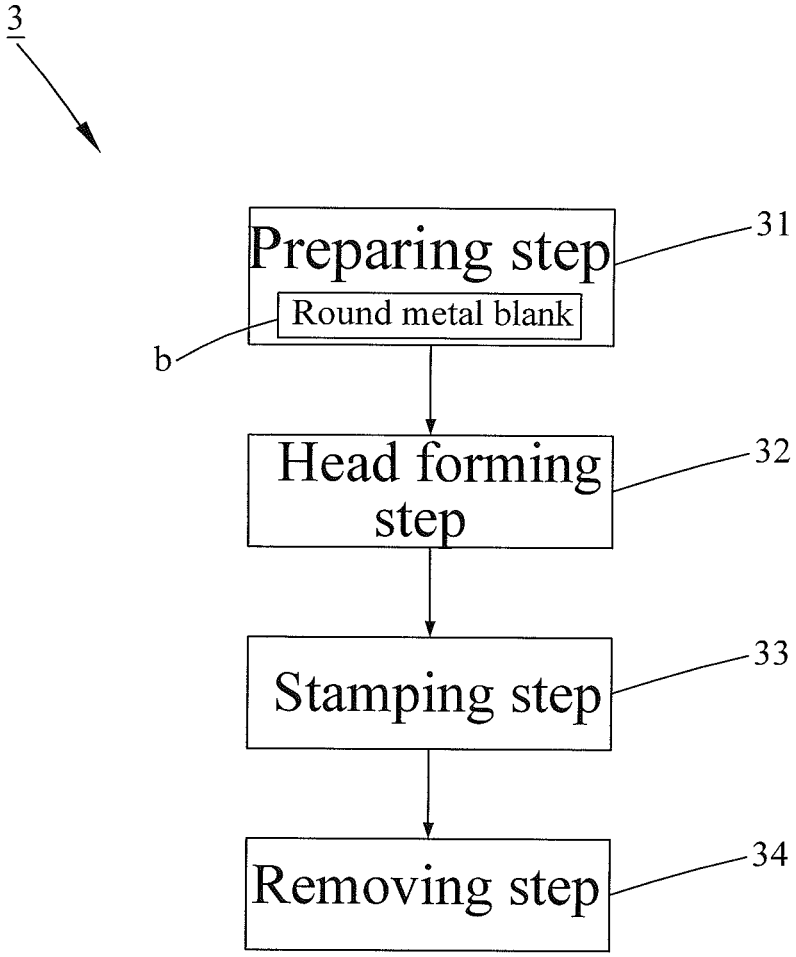
FIG. 3 (PRIOR ART)
FIG. 3 is a block diagram of a second traditional method showing the steps of making a spanner.
Figure 4:
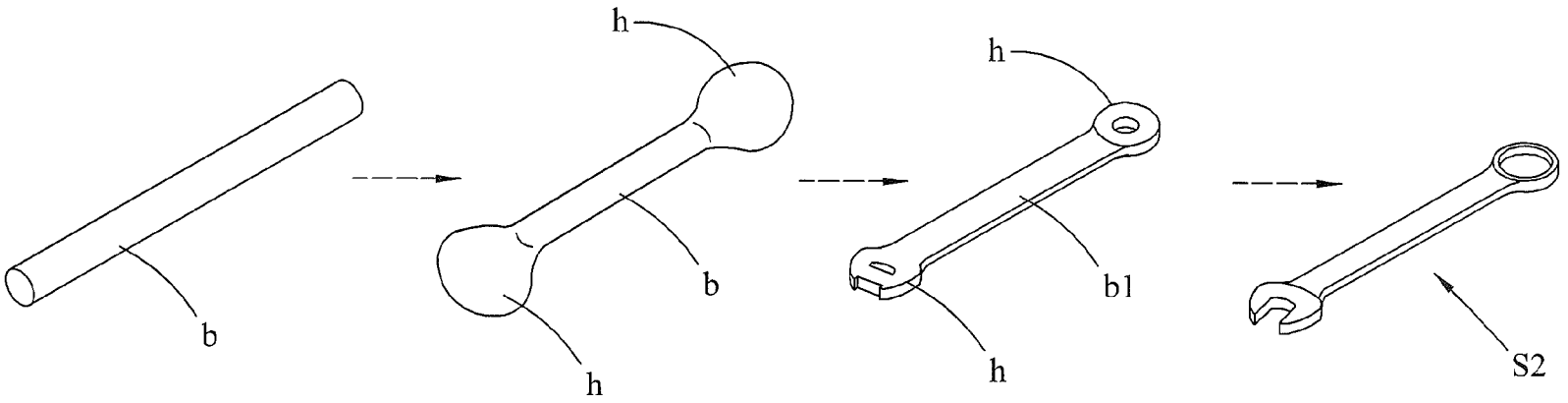
FIG. 4 (PRIOR ART)
FIG. 4 is a perspective representation of making the spanner in accordance with the second traditional method.
Figures 2, 7:
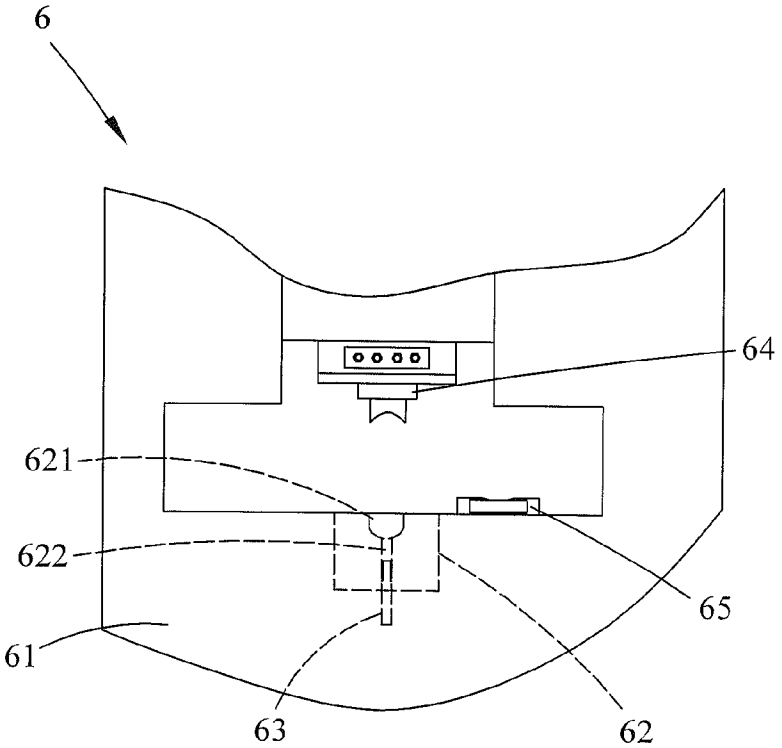
Figures 1, 7:
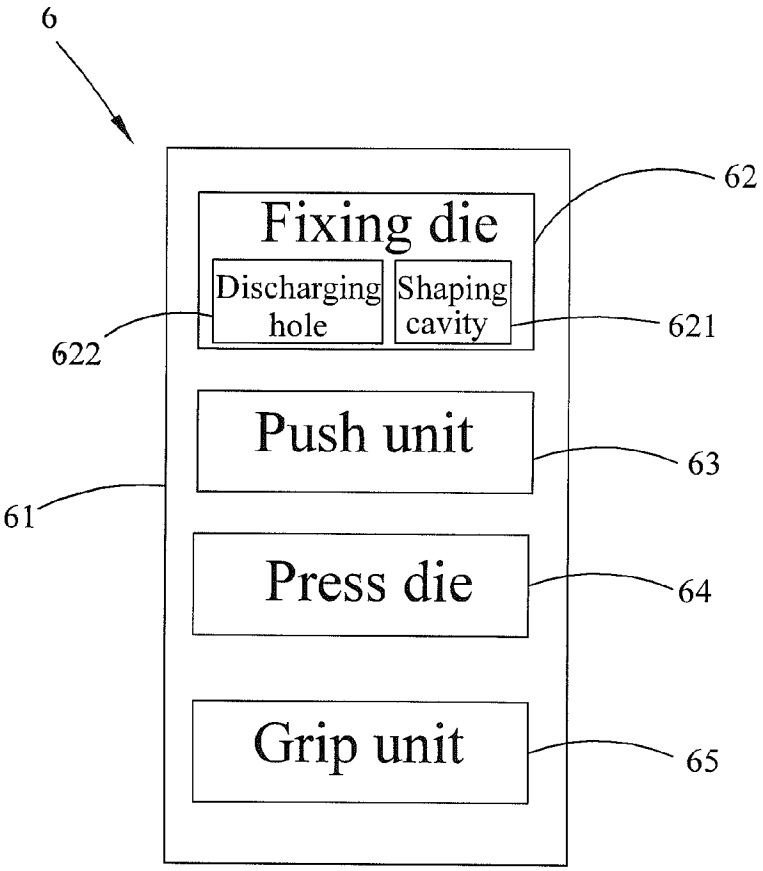

Furthermore, the first end stamping step 43 presses the head 51 to form a first arch-shaped part d1 which is a part with a curved or arched peripheral wall as the archetype of the spanner end. More specifically, the first end stamping step 43 in this preferred embodiment applies a heading machine 6 to press the head 51. Referring to FIG. 7-1 and FIG. 7-2, the heading machine 6 comprises a body 61, a fixing die 62 and a push unit 63 disposed on the body 61, a press die 64 disposed opposite the fixing die 62 and a grip unit 65 disposed on the body 61 for gripping and moving the metal blank 5 to where the fixing die 62 is located. The fixing die 62 has a shaping cavity 621 formed thereon and a discharging hole 622 communicating with the shaping cavity 621. The push unit 63 can be inserted into the discharging hole 622. When the metal blank 5 with the head 51 is placed onto the fixing die 62 by using the grip unit 62, the head 51 is accommodated in the shaping cavity 621 and pressed by the press die 64 to form the first arch-shaped part d1 as shown in FIG. 6-1. Further, the time of punching a hole in the head 51 is decided by the structure of the dies. For example, the head 51, as shown in FIG. 6-1, may not be punched or perforated in this step, or a first archetypal hole h1 may be punched in the first arch-shaped part d1 at the time of pressing as shown in FIG. 6-2 so that it is set as an initial form of a first finished hole 81 of the finished spanner 8. The push unit 63 then goes into the discharging hole 622 to push the metal blank 5. Thus, the metal blank 5 is removed from the fixing die 62 to continue the step 44.

Figures 2, 8:
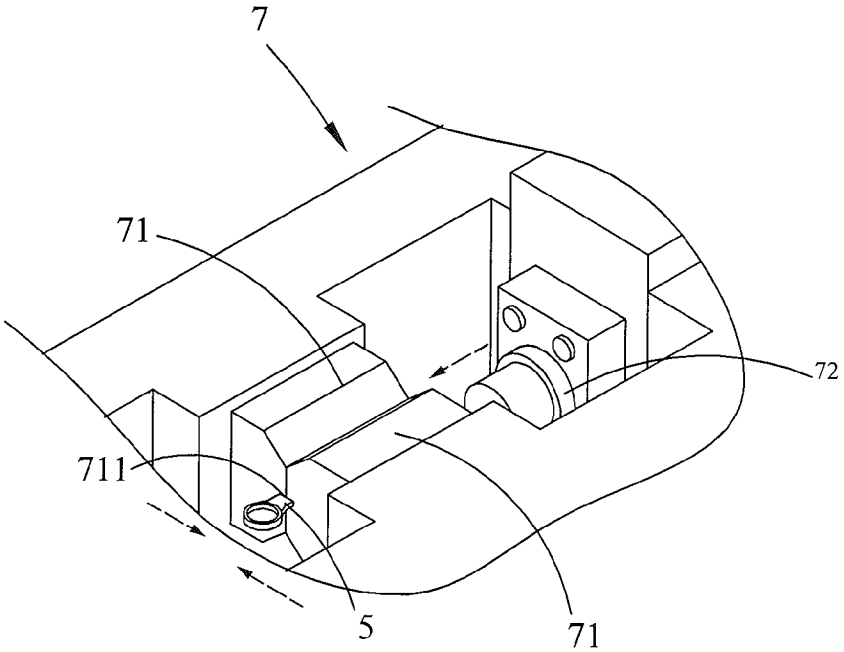
Figures 1, 8:
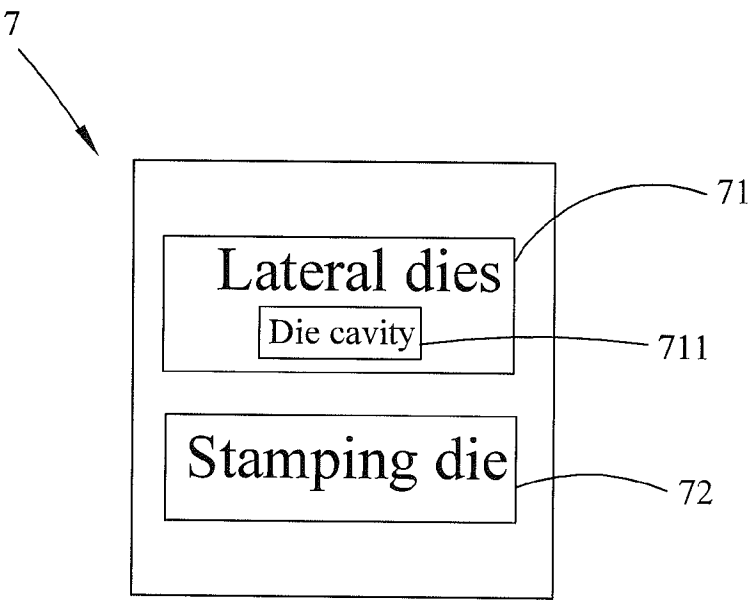

The second end stamping step 44 presses a shank end 521 of the shank 52 in an opposite direction to or far away from the head 51 to form a second arch-shaped part d2 which is a part with a curved or arched peripheral wall as the archetype of the spanner end. More specifically, the second end stamping step 44 in this preferred embodiment applies a forming machine 7 to press the shank end 521 of the shank 52. Referring to FIG. 8-1 and FIG. 8-2, the forming machine 7 comprises a pair of lateral dies 71 between which the metal blank 5 is placed and gripped and a stamping die 72 disposed in relation to the pair of lateral dies 71. The pair of lateral dies 71 forms a die cavity 711 thereon. When the shank 52 of the metal blank 5 is firmly gripped by the lateral dies 71, the stamping die 72 presses the shank end 521 so that the shank end 521 becomes deformed and expanded by the pressing force. The deformed and expanded shank end 521 then fills the die cavity 711 to form the second arch-shaped part d2 whose size may be smaller than the size of the first arch-shaped part d1. Further, the time of punching a hole in the shank end 521 is also decided by the structure of the dies. For example, the shank end 521, as shown in FIG. 6-1, may not be punched or perforated in this step, or a second archetypal hole h2 may be punched in the second arch-shaped part d2 at the time of pressing as shown in FIG. 6-2 so that it is set as an initial form of a second finished hole 82 of the finished spanner 8. Thereafter, the metal blank 5 is removed from the lateral dies 71 to attain a half-finished spanner ready for the next step 45.

The trimming step 45 removes scrap or redundant metal projecting from the first arch-shaped part d1 of the head 51 and the second arch-shaped part d2 of the shank 52 by pressing two ends of the half-finished spanner again, namely, the head 51 and the shank end 521 as discussed. Because the amount of the scrap is not much, this step 45, different from the prior technique, attains the removal of the scrap without using the stamping press with large metric tons. This reduces the cost and makes the pressed portions neat. Concurrently, respective finished holes 81, 82 with the desired dimensions and shapes are also formed on the head 51 and the shank end 521, thereby completing a finished spanner 8. It is also noted that these finished holes 81, 82 can be more easily and quickly punched if the first archetypal hole h1 and the second archetypal hole h2, as previously described, are made before the trimming step 45.

The shape of the finished spanner 8 can be classified into three common types. For example, as shown in FIG. 6-2, the A type comprises two ring-shaped heads at two ends of the spanner 8, each of which forms a central hole 81(82). The B type comprises a ring-shaped head with a central hole 81 and jaws with an arch-shaped contour and an open hole 82. The C type two sets of jaws, each of which provides an open hole 81 (82). The shape of the spanner 8 can be changed according to the structure of manufacturing dies.

Figure 9:
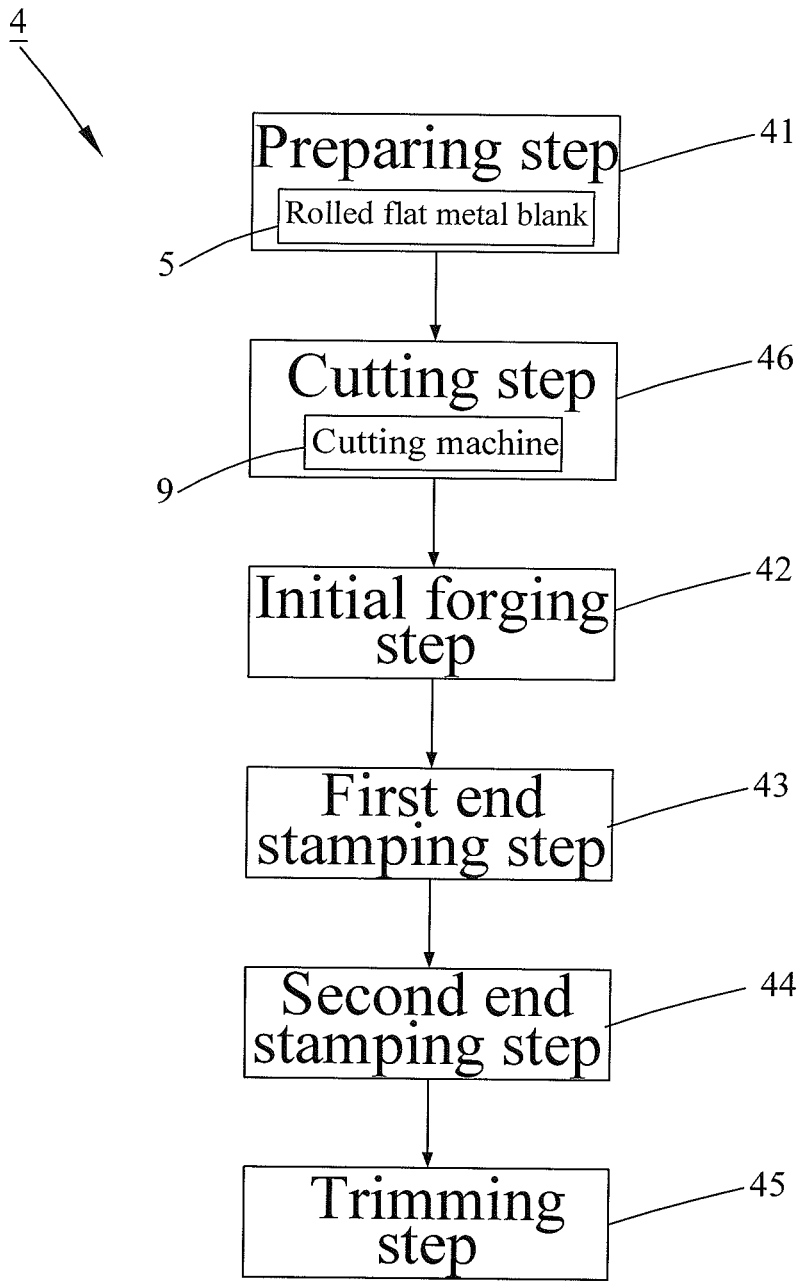
FIG. 9 is a block diagram of a second preferred embodiment of this invention showing the steps of making a spanner.

Referring to FIG. 9, a second preferred embodiment of this invention for making a spanner 8 still comprises a preparing step 41, an initial forging step 42, a first end stamping step 43, a second end stamping step 44 and a trimming step 45. This embodiment is characterized in that the flat metal blank 5 of the preparing step 41 is continuously rolled, and the preparing step 41 is followed by a cutting step 46. The cutting step 46 cuts the rolled metal blank 5 into sections by using a cutting machine 9 at the time of feeding the metal blank 5. After the metal blank 5 is cut into sections, these sections can be directly and sequentially gripped and fed for continuing the steps 42, 43, 44, 45. The actions of the steps 42, 43, 44, 45 are the same as those of the first preferred embodiment and herein are omitted.

Figure 10:
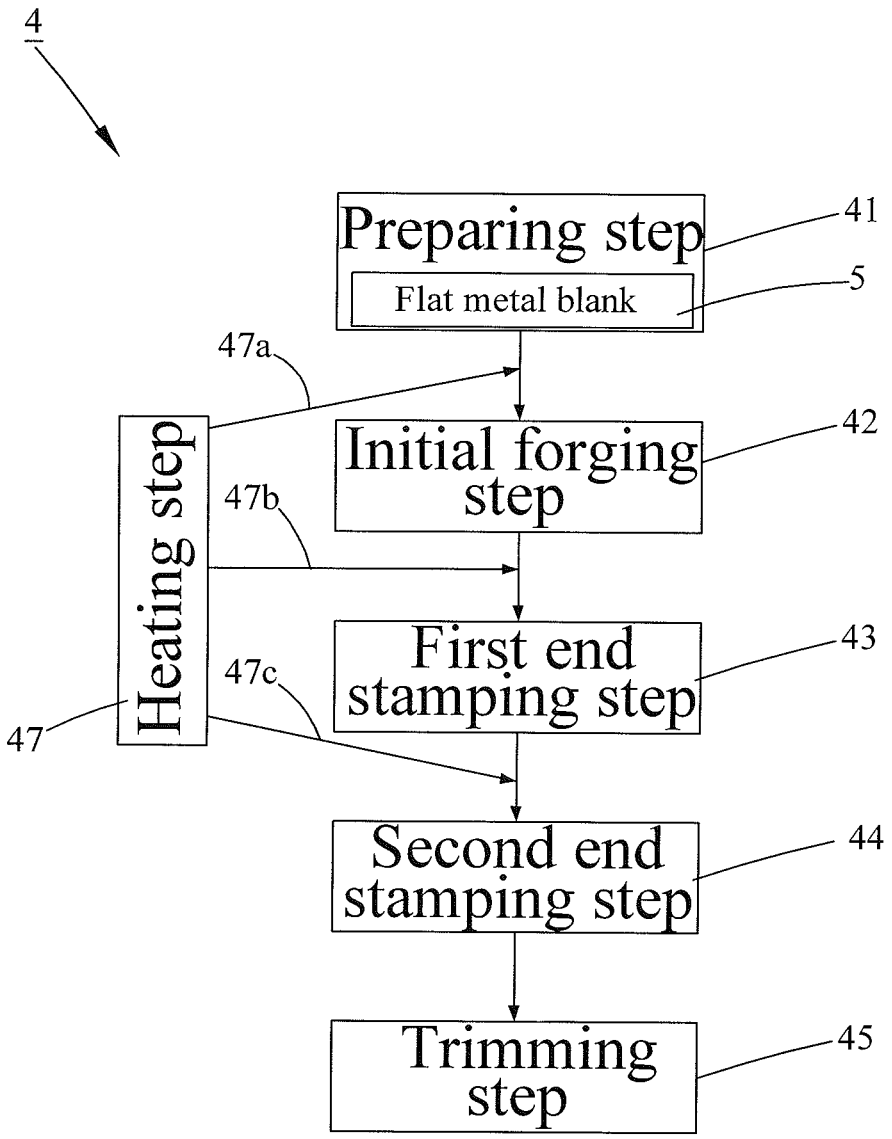
FIG. 10 is a block diagram of a third preferred embodiment of this invention showing the steps of making a spanner.
Figure 11:
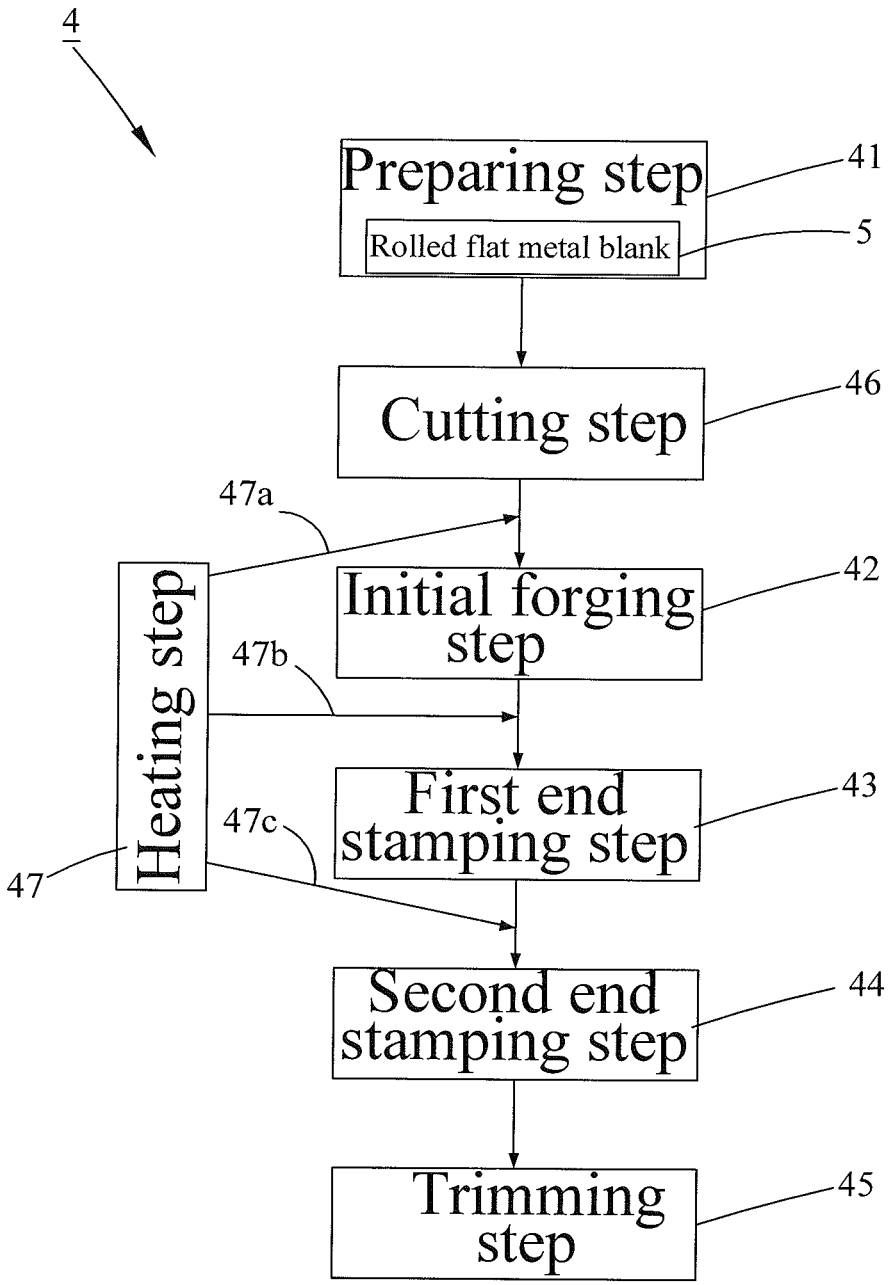
FIG. 11 is a block diagram of a fourth preferred embodiment of this invention showing the steps of making a spanner.

Referring to FIG. 10 and FIG. 11, a third preferred embodiment and a fourth preferred embodiment of this invention still comprise a preparing step 41, an initial forging step 42, a first end stamping step 43, a second end stamping step 44 and a trimming step 45. The fourth preferred embodiment differs from the third preferred embodiment in having the rolled metal blank 5 and the cutting step as previously described. Particularly, these two preferred embodiments include a heating step 47 to heat the metal blank 5 by the high-frequency induction or other heating means. Specifically, the heating step 47 can be executed before the initial forging step 42, the first end stamping step 43 or the second end stamping step 44. Alternatively, the heating step 47 can be executed before all the steps 42, 43, 44. As used herein, the initial forging step 42 follows a first heating step 47*a*, the first end stamping step 43 follows a second heating step 47*b*, and the second end stamping step 44 follows a third heating step 47*c*. By using the heating means, the metal blank 5 forms the head 51 and the shank 52 quickly and easily in the initial forging step 42, shapes the first arch-shaped part d1 quickly and easily in the first end stamping step 43 and/or shapes the second arch-shaped part d2 quickly and easily in the second end stamping step 44. This also effects the small amount of the scrap, decreases the waste of the material, shortens the working time and increasing the processing efficiency.

Therefore, this invention attains the effects:

1. When the preparing step 41 prepares the flat metal blank 5, the following stamping steps 43, 44 can use the simple heading machine and the forming machine capable of arranging a mass production to replace traditional stamping presses with the large bulk and metric tons. Therefore, the processing and manufacturing efficiency can be increased.
2. The stamping steps 43, 44 subject the head 51 and the shank end 521 of the shank 52 to respective pressing works, so the appearance of the spanner 8 can be quickly and easily shaped with less scrap, and the unnecessary loss and waste of the material is decreased. The trimming step 45 only needs to remove very little scrap, thereby completing the finished spanner 8 quickly and easily.

To sum up, this invention takes advantage of the flat metal blank to form the head and the shank directly. Therefore, two ends of the metal blank in the two stamping steps can be directly formed into the arch-shaped parts prepared for the archetype of the spanner to attain a half-finished spanner. The trimming step is mainly to remove the scrap or redundant metal left on the two ends of the half-finished spanner and make sure that the finished hole are well punched, thereby completing a finished spanner. Therefore, the preparation of the flat metal blank allow the arch-shaped parts to be directly and quickly formed, thereby shortening the processing time, increasing the processing and forming efficiency and decreasing the cost.

While the embodiments of this invention are shown and described, it is understood that further variations and modifications may be made without departing from the scope of this invention.

What is claimed is:

1. A method of making a spanner comprising:

a preparing step for preparing a flat metal blank;

an initial forging step for forging and pressing a part of said flat metal blank whereby a head is formed at one end of said flat metal blank, and a shank is forged and extended outwards from said head, said shank having a reduced width smaller than a width of said head;

a first end stamping step for pressing said head whereby said head forms a first arch-shaped part;

a second end stamping step for pressing a shank end of said shank far away from said head whereby said shank end becomes expanded by a pressing force to form a second arch-shaped part, a size of said second arch-shaped part being smaller than a size of said first arch-shaped part of said head; and a trimming step for pressing said head and said shank end again to remove scrap projecting from said first arch-shaped part and said second arch-shaped part and punch a first finished hole and a second finished hole in said head and said shank end respectively, thereby completing a finished spanner.

2. The method of making a spanner according to claim 1, further comprising the step of forming a width of said flat metal blank in said preparing step to equal a maximum outer diameter of said finished spanner.

3. The method of making a spanner according to claim 1, the step of continuously rolling said flat metal blank in said preparing step, said preparing step being followed by a cutting step, said cutting step cutting said metal blank into sections with a cutting machine whereby each section of said cut metal blank is gripped and fed for continuing said initial forging step.

4. The method of making a spanner according to claim 1, wherein said first end stamping step forms said first arch-shaped part by pressing said head and also punches an archetypal hole as an initial form of said first finished hole in said first arch-shaped part.

5. The method of making a spanner according to claim 1, wherein said first end stamping step presses said head with a heading machine, said heading machine comprises a body, a fixing die and a push unit disposed on said body, a press die disposed opposite said fixing die and a grip unit disposed on said body for gripping and moving said metal blank to where said fixing die is located, said fixing die having a shaping cavity formed thereon and a discharging hole communicating with said shaping cavity and allowing an insertion of said push unit.

6. The method of making a spanner according to claim 1, wherein said second end stamping step forms said second arch-shaped part by pressing said shank end and also punches an archetypal hole as an initial form of said second finished hole in said second arch-shaped part.

7. The method of making a spanner according to claim 1, wherein said second end stamping step presses said shank end of said shank with a forming machine, said forming machine comprises a pair of lateral dies between which said shank is placed and gripped and a stamping die disposed in relation to said pair of lateral dies, said pair of lateral dies forming a die cavity thereon.

8. The method of making a spanner according to claim 1, wherein said initial forging step follows a first heating step, said first end stamping step follows a second heating step, and said second end stamping step follows a third heating step.

9. The method of making a spanner according to claim 1, wherein a heating step is added before any of said initial forging step, said first end stamping step or said second end stamping step.

* * * * *